United States Patent [19]

Schulz

[11] Patent Number: 5,014,365

[45] Date of Patent: May 14, 1991

[54] GAS-FITTED PROTECTIVE HELMET

[75] Inventor: Arthur M. Schulz, Roselle, Ill.

[73] Assignee: Maxpro Helmets, Inc., Chicago, Ill.

[21] Appl. No.: 300,329

[22] Filed: Jan. 23, 1989

[51] Int. Cl.[5] ..... A42B 3/02; A63B 71/16

[52] U.S. Cl. ..... 2/412; 2/413; 2/414; 2/425

[58] Field of Search ..... 2/412, 413, 414, 415, 2/425, 410

[56] References Cited

U.S. PATENT DOCUMENTS

| | | | |
|---|---|---|---|
| 1,596,320 | 8/1926 | Sonnett | 137/223 |
| 1,662,527 | 3/1928 | MacDonald | 273/65 A |
| 2,434,641 | 1/1948 | Burns | 267/117 |
| 2,577,274 | 12/1951 | Sampson | 267/117 |
| 3,148,376 | 9/1964 | Aileo | 2/6 |
| 3,248,738 | 5/1966 | Morgan | 2/414 X |
| 3,344,433 | 10/1967 | Stapenhill | 2/420 |
| 3,462,763 | 8/1969 | Schneider et al. | 2/413 |
| 3,609,764 | 10/1971 | Morgan | 2/414 |
| 3,668,704 | 6/1972 | Conroy et al. | 2/413 |
| 3,713,640 | 1/1973 | Morgan | 267/117 |
| 3,720,955 | 3/1973 | Rawlings | 2/415 |
| 3,761,959 | 10/1973 | Dunning | 2/413 |
| 3,843,970 | 10/1974 | Marietta | 2/415 |
| 3,849,801 | 11/1974 | Holt et al. | 2/413 |
| 3,859,666 | 1/1975 | Marietta et al. | 2/412 |
| 3,882,547 | 5/1975 | Morgan | 2/414 |
| 3,994,020 | 11/1976 | Villari | 2/413 |
| 3,994,021 | 11/1976 | Villari et al. | 2/413 |
| 3,994,022 | 11/1976 | Villari et al. | 2/413 |
| 4,023,213 | 5/1977 | Rovani | 2/413 |
| 4,038,700 | 8/1977 | Gyory | 2/413 |
| 4,287,613 | 9/1981 | Schulz | 2/413 |
| 4,375,108 | 3/1983 | Gooding | 2/413 |
| 4,566,137 | 1/1986 | Gooding | 2/413 |
| 4,845,786 | 7/1989 | Chiarella | 2/412 |

FOREIGN PATENT DOCUMENTS

| | | |
|---|---|---|
| 1171173 | 9/1958 | France . |
| 1203481 | 7/1959 | France . |
| 947772 | 1/1964 | United Kingdom . |

*Primary Examiner*—Wm. Carter Reynolds

*Attorney, Agent, or Firm*—Neuman, Williams, Anderson & Olson

[57] ABSTRACT

A protective helmet employs an inflatable bladder on the interior of the helmet. The inflatable bladder has cells that extend to the lower rear octants of the wearer's head and also to either the crown or upper front octants of the wearer's head. The cells are inflatable through a single valve and properly secure the helmet to the wearer's head during use. In the preferred embodiment, the helmet is fully lined with resilient material interposed between the bladder and the wearer's head.

10 Claims, 3 Drawing Sheets

Fig. 1
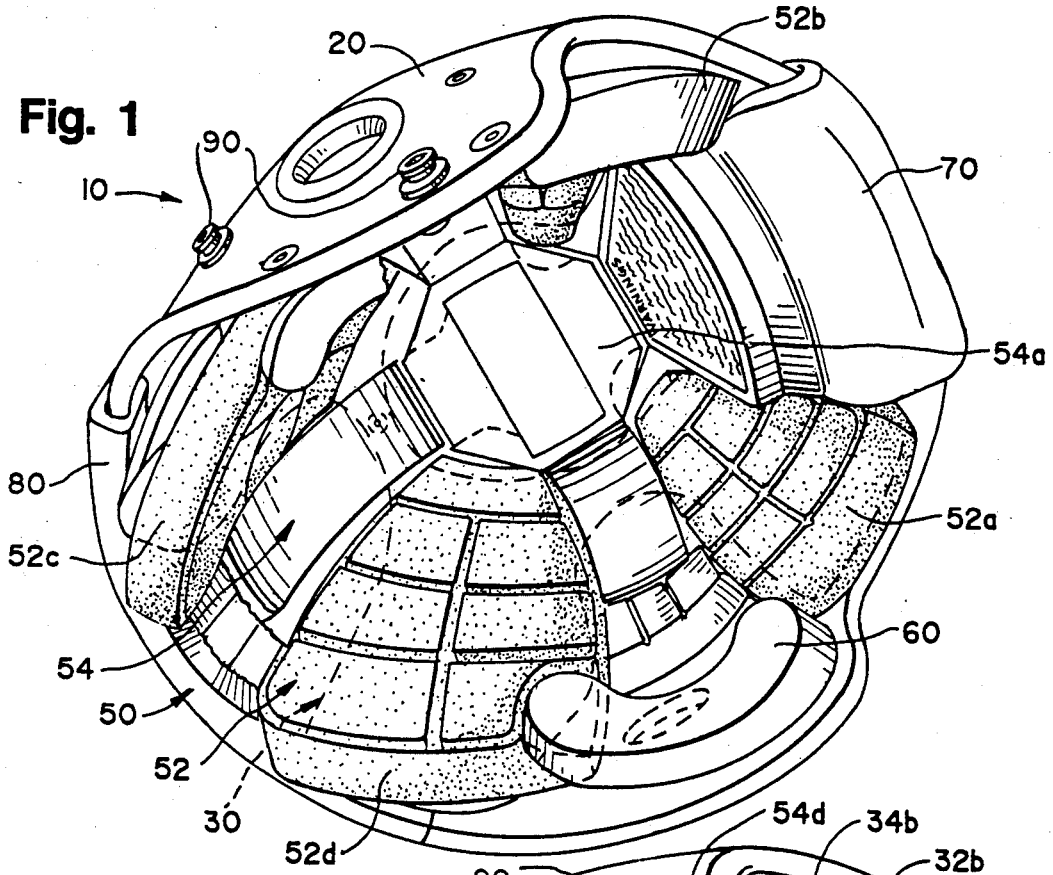
Fig. 2
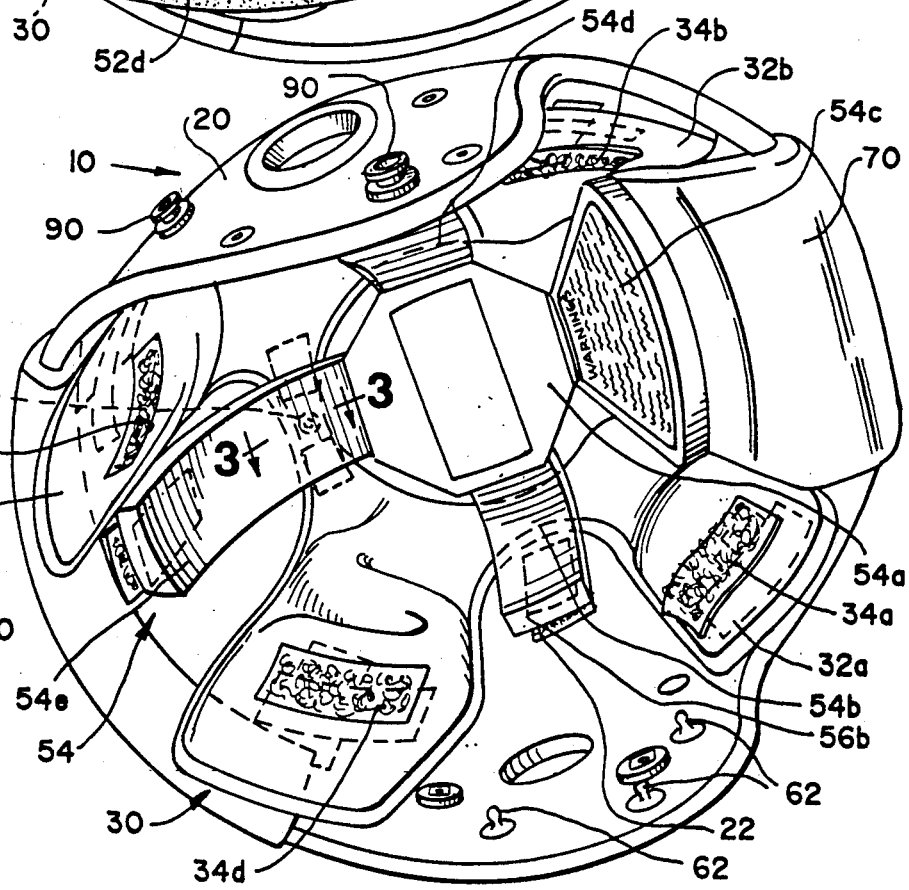
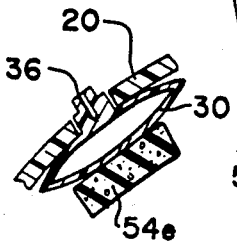
Fig. 3

GAS-FITTED PROTECTIVE HELMET

FIELD OF THE INVENTION

This invention relates to improved protective headgear. More particularly, this invention relates to a protective helmet employing an inflatable bladder on the interior of the helmet. The inflatable bladder has cells that extend to the lower rear octants of the wearer's head and also to either the crown or the upper front octants of the wearer's head. The cells are inflatable through a single valve and properly secure the helmet to the wearer's head during use. In the preferred embodiment, the helmet is fully lined with resilient material interposed between the bladder and the wearer's head.

BACKGROUND OF THE INVENTION

Protective headgear is generally worn to shield the wearer from injury-causing blows to the head during athletic contests and recreational activities like football, hockey, bicycling and motorcycling. A conventional protective helmet typically consists of a rigid outer shell lined with at least one layer of resilient material. Such resilient liner material distributes and diminishes the force of impacts delivered to the exterior of the outer shell, and prevents direct transmission of that force to the wearer's head. Thus, a primary objective of protective helmet designs is to maximize the amount of impact energy absorbed and dissipated by the helmet.

In addition to attempting to maximize the absorption and dissipation of impact energy, another objective of protective headgear designs is to achieve a proper fit to the wearer's head. Human skulls are, like fingerprints, all different in shape and size. Consequently, a helmet having fixed internal dimensions cannot provide a comfortable, secure fit for all wearers. In addition, inadequate ventilation or circulation of air through the liner and around the head is a frequent problem in poorly designed helmets.

The present invention takes advantage of certain anatomical commonalities among skulls, and provides for the adjustment of the helmet's internal dimensions to properly fit heads of various shapes and sizes. In particular, the lower rear octants of the skull have been found to provide an effective location for securing the helmet to the head to maintain proper positioning during use. The lower rear octants of the skull are the portions of the skull opposite the face and immediately above the base of the skull. In addition, the crown or topmost region of the skull, as well as the upper octants of the skull generally, including the temples, have been found to provide an effective platform upon which to elevate the helmet from the head.

The present invention employs a bladder having cells that extend over the crown or upper front octants and over the lower rear octants of the head. Upon inflation through a single valve, the bladder cells apply pressure to these locations to properly and comfortably position the outer shell and resilient liner around the wearer's head.

Adjustable helmets in the past have mostly failed to take advantage of the anatomical characteristics of the skull utilized by the present invention. For example, Schneider U.S. Pat. No. 3,462,763 describes an inflatable helmet pad which extends over the crown, front, sides and rear of the wearer's head. The inflatable pad of the Schneider patent, however, does not extend over the lower rear skull octants, and therefore would not be as effective in properly securing the helmet to heads of different shapes and sizes. Similarly, Conroy U.S. Pat. No. 3,688,704 describes an inflatable helmet pad formed of a single cell extending over the top, front and sides of the head, but the cell does not extend to the lower rear octant of the wearer's head.

Some past helmet designs employed inflatable pads that extended over the crown or upper front octant of the skull and also over the lower rear octant of the skull. However, such past designs were not inflatable through a single valve as in the present invention. For example, Morgan U.S. Pat. No. 3,609,764 describes a helmet having a number of inflatable cells for sizing, some of which appear to extend over the lower rear octant. However, there is no teaching in the Morgan patent that the cells should or could be interconnected for inflation through a single valve. Similarly, Dunning U.S. Pat. No. 3,761,959 describes an inflatable helmet pad with interconnected front, side and rear members and a separately inflatable top member. Likewise, Schulz U.S. Pat. No. 4,287,613 describes an inflatable helmet pad having a crown compartment and a lower rear compartment, but does not suggest that the crown and lower rear compartments are inflated through a single valve. Achieving uniform inflation of the bladder compartments would be more difficult in designs employing multiple valves, and sizing the helmet to the wearer's head would also be less convenient using multiple valves.

The present invention is directed to overcoming these and other difficulties inherent in prior art helmet designs. In the present invention, an inflatable bladder is mounted on the interior surface of the outer shell of the helmet. The bladder has cells that are inflatable through a single valve and that extend to the lower rear octants of the wearer's head and also to either the crown or the upper front octants of the wearer's head. In use, air is pumped into the bladder to properly position the helmet around the wearer's head. The helmet is held in place primarily by pressure applied by the bladder at the lower rear octants of the wearer's head. The helmet is elevated from the head by pressure applied by the bladder at the upper octants of the wearer's head. In the preferred embodiment, the helmet is fully lined with resilient material interposed between the bladder and the wearer's head.

OBJECTS OF THE INVENTION

An object of the present invention is to provide a protective helmet that absorbs and dissipates an effective amount of impact energy directed against the exterior of the helmet.

Another object of the invention is provide a protective helmet that achieves a proper fit to wearers' heads of different shapes and sizes.

A further object of the invention is to provide a protective helmet employing a bladder that is inflatable through a single valve.

A still further object of the invention is to provide a protective helmet that is fully lined on its interior with resilient material.

SUMMARY OF THE INVENTION

The above and other objects are accomplished by providing a protective helmet comprising an outer shell and an inflatable bladder mounted on the interior surface of the shell. The bladder comprises a plurality of cells extending to the lower rear octants of the wearer's head and to the upper octants of the wearer's head. The cells are inflatable through a single valve.

In the preferred embodiment of the invention, the protective helmet also comprises a liner formed of resilient material interposed between the inflatable bladder and the wearer's head. The liner in the preferred embodiment substantially covers the interior surface of the outer shell. In this embodiment, the liner comprises an assembly of first interconnected segments of resilient material engaged with second interconnected segments of resilient material. At least one of the segments comprises a first portion of resilient material having an internal pocket and a second portion of resilient material disposed within the pocket. The resilient material forming the first portion has a resiliency that is greater than that of the second portion. The resilient material of the first portion is preferably cross-linked polyethylene.

BRIEF DESCRIPTION OF THE DRAWINGS

FIG. 1 is a perspective view of the interior of one embodiment of the protective helmet, particularly illustrating the outer shell, inflatable bladder, and resilient liner assembly.

FIG. 2 is a perspective view of the interior of the embodiment illustrated in FIG. 1, with one portion of the resilient liner assembly removed to more clearly illustrate the inflatable bladder.

FIG. 3 is an enlarged sectional view of a portion of FIG. 2, taken in the direction of arrows 3—3 in FIG. 2, showing in cross-section the valve assembly of the inflatable bladder.

DETAILED DESCRIPTION OF THE PREFERRED EMBODIMENT

Figure 4:
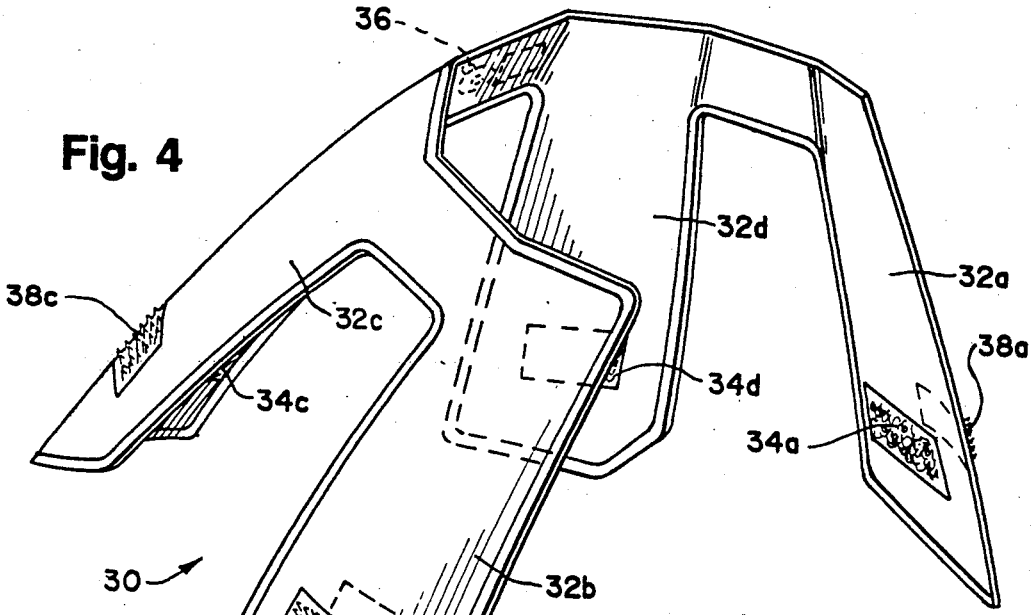
FIG. 4 is an exploded perspective view of the inflatable bladder and resilient liner assembly in partially disassembled state.

Turning first to FIG. 1 of the drawings, a protective helmet or headgear 10 is shown from an interior perspective view. Helmet 10 includes outer shell 20, inflatable bladder 30 (shown mostly in broken lines), and resilient liner assembly 50. Liner assembly 50 includes first interconnected segment group 52 and second interconnected segment group 54. Segment group 52 includes individual segments 52*a*, 52*b*, 52*c* and 52*d*. Segment group 54 includes resilient crown portion 54*a*. As shown in FIG. 1, segment group 52 is engaged and enmeshed with segment group 54, and together substantially cover the interior surface of outer shell 20. In the preferred embodiment, the segments of groups 52 and 54 comprise cross-linked polyethylene, but other materials effective in absorbing impact energy could also be employed.

As further shown in FIG. 1, helmet 10 preferably includes ear pad 60, forehead pad 70 and rear edge pad 80. Snaps 90 are provided on the exterior surface of outer shell 20 for fastening a chin strap (not shown). Outer shell 20 can also accommodate a face mask (not shown).

Turning now to FIG. 2, the helmet of FIG. 1 is shown again from an interior perspective view, but with segment group 52 removed to more clearly illustrate inflatable bladder 30 and segment group 54. In the illustrated embodiment, inflatable bladder 30 includes cells 32*a*, 32*b*, 32*c* and 32*d*, which are interconnected and inflatable through a single valve 36. When the helmet is worn, cells 32*a* and 32*b* extend downwardly from the crown to the upper front octants or temple of the wearer's head. Alternatively, cells 32*a* and 32*b* could be replaced with a cell or cells that extend only over the crown or topmost region of the wearer's head. The purpose of cells 32*a* and 32*b* is to elevate the helmet from the wearer's head. Cells 32*c* and 32*d* extend downwardly from the crown to the lower rear octants of the wearer's head. The purpose of cells 32*c* and 32*d* is to secure the helmet to the lower rear portion of the wearer's head.

As shown in FIG. 2, fastening strips 34*a*, 34*b*, 34*c* and 34*d*, preferably formed of disengagable loop fastening material, are attached to the interior facing sides of cells 32*a*, 32*b*, 32*c* and 32*d*, respectively. Fastening strips 34*a* through 34*d* interact with corresponding fastening strips, preferably formed of disengagable hook fastening material, attached to the exterior facing side of segment group 52 (not shown in FIG. 2). Fastening strips 34*a* through 34*d* thus secure the resilient segments of group 52 to the interior of helmet 10. In like manner, bladder 30 is mounted on the interior surface of outer shell 20, preferably by disengagable hook and loop fastening material. Suitable disengagable hook and loop material is commercially available under the trademark VELCRO.

FIG. 2 also shows resilient segments 54, which includes crown portion 54*a* and individual segments 54*b*, 54*c*, 54*d* and 54*e*. In the illustrated embodiment, crown portion 54*a* can be integrally molded with the product's name. Similarly, segment 54*c*, which extends over the wearer's forehead, is integrally molded with a warning message on the risks of helmet use. Segments 54*b* through 54*d* are mounted on the interior surface of outer shell 20, preferably using strips of disengagable hook and loop material. For example, FIG. 2 shows disengagable hook fastening strip 56*b* (broken line), which is attached to the exterior facing side of segment 54*b*. Strip 56*b* interacts with corresponding fastening strip 22, preferably formed of disengagable loop fastening material, which is attached to the interior surface of outer shell 20. Snaps 62 are provided for attaching ear pad 60 (not shown) to the interior surface of outer shell 20.

Turning now to FIG. 3, an enlarged view of a portion of FIG. 2, taken in the direction of arrows 3—3 in FIG. 2, is shown in cross-section. FIG. 3 illustrates the relative positions of valve 36, bladder 30, outer shell 20, and resilient liner segment 54*e*. As shown in FIG. 3, valve 36 provides fluid access to the interior of bladder 30, allowing for inflation of bladder 30 by means of a pin attached to an inflation device such as a hand pump or the like. Bladder 30 is normally inflated with a gas such as air, but other suitable fluids could also be used. Valve 36 protrudes through a hole in outer shell 20 to allow bladder 30 to be inflated from the exterior of the helmet, preferably after the helmet is first put on by the wearer. Because the function of bladder 30 is to properly fit the helmet to the wearer's head, bladder 30 is normally inflated to a pressure of no more than about 1 psig. This is in contrast to some prior art designs in which the internal bladders were included to absorb impact energy and required inflation to about 10 psig or more.

Turning now to FIG. 4, inflatable bladder 30 and resilient liner assembly 50 are shown in partially disassembled state. As previously indicated, bladder 30 comprises cells 32*a*, 32*b*, 32*c* and 32*d*, which are inflatable through valve 36. Cells 32*a* through 32*d* are mounted on the inside surface of the helmet's outer shell (not shown) by fastening strips 38*a*, 38*b*, 38*c* and 38*d* (not shown), preferably formed of disengagable hook material. Similarly, on the interior facing side of bladder 30, fastening strips 34*a*, 34*b*, 34*c* and 34*d*, preferably formed of disengagable loop material, cooperate with corresponding fastening strips 58*a*, 58*b*, 58*c* and 58*d* (not shown), preferably formed of disengagable hook material, to fasten liner assembly 50 to bladder 30.

FIG. 4 also illustrates the manner in which first segment group 52 engages second segment group 54 to form liner assembly 50. Specifically, individual segments 52*a*, 52*b*, 52*c* and 52*d* engage and enmesh with individual segments 54*c* and 54*d*, as well as segments 54*b* and 54*e* (not illustrated in FIG. 4), to form a liner assembly that substantially covers the interior surface of the helmet's outer shell. As shown in FIG. 4, the segments forming liner 50 conform to the contour of the helmet's outer shell.

The enmeshed structure of liner assembly 50 also allows for the circulation of air between the segments to provide effective ventilation around the wearer's head. In particular, it has been found desirable to provide vacant space between adjacent liner segments to allow heat energy from the wearer's head to radiate away from the immediate vicinity of the head and toward the outer shell of the helmet. The enmeshed structure shown in FIG. 4 provides vacant space in the radial direction between each of the alternating segments of groups 52 and 54 to provide effective ventilation of radiated heat. As used herein, the radial direction originates at the center of the wearer's head and proceeds linearly toward the outer shell.

As further illustrated in FIG. 4, segment 54*d* of second segment group 54 has, on its exterior facing side, a fastening strip 56*d*, preferably formed of disengagable hook material, which interacts with a corresponding fastening strip (not shown) located on the interior surface of the helmet's outer shell, to attach resilient liner assembly 50 to the outer shell. Fastening strips are also included on the exterior facing sides of the remaining segments 54*b* and 54*e*, which are not illustrated in FIG. 4.

Figure 5:
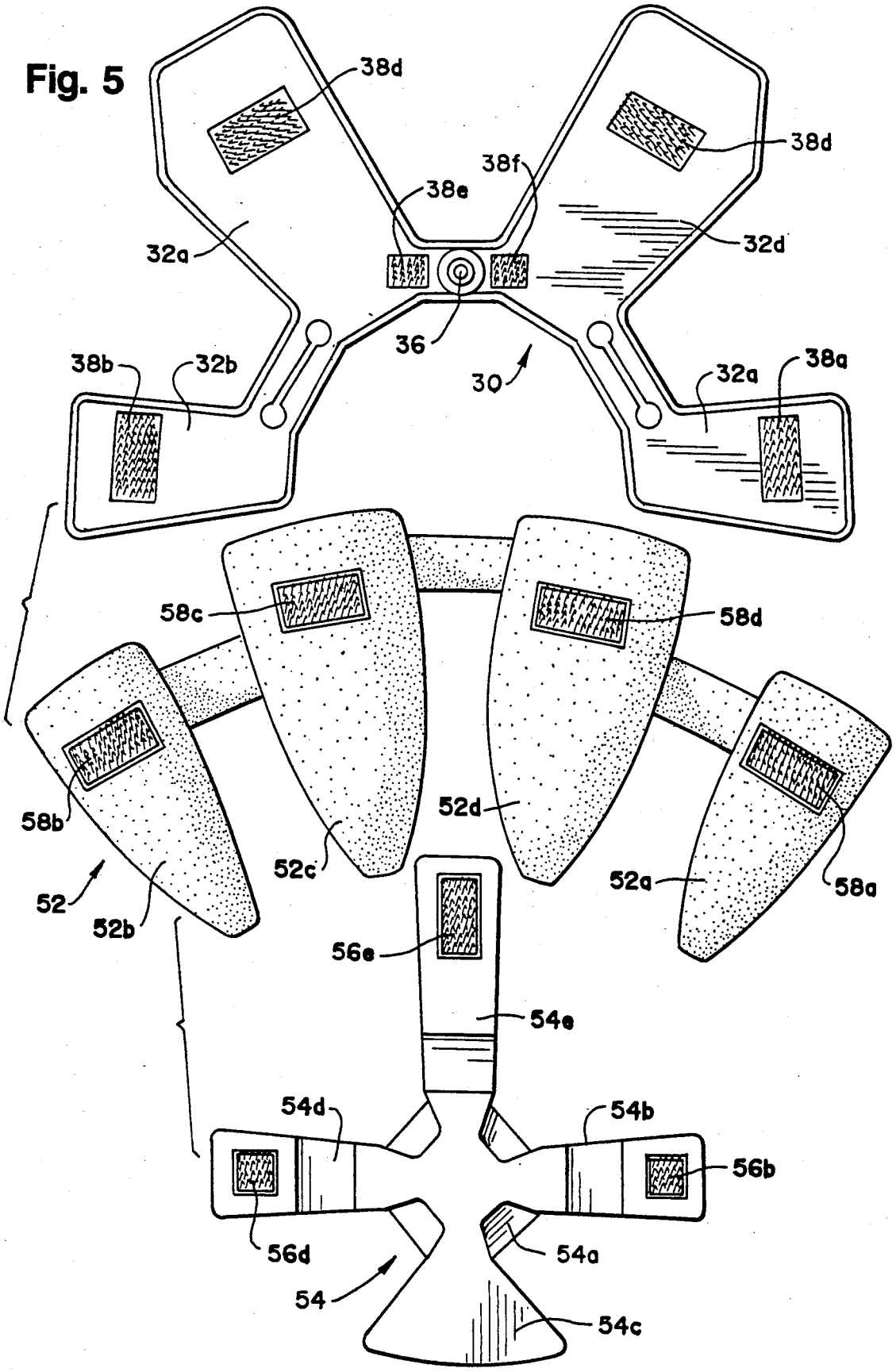
FIG. 5 is a bottom plan view of the inflatable bladder and the first group of interconnected segments and the second group of interconnected segments, which together form the resilient liner assembly, all in disassembled state.

Turning to FIG. 5, inflatable bladder 30, first interconnected segment group 52 and second interconnected segment group 54 are shown in disassembled state. As previously described, bladder 30 includes cells 32*a*, 32*b*, 32*c* and 32*d*, all of which are interconnected and inflatable through a single valve 36. Fastening strips 38*a*, 38*b*, 38*c* and 38*d*, preferably formed of disengagable hook material, are attached to the exterior facing sides of cells 32*a*, 32*b*, 32*c* and 32*d*, respectively. Strips 38*a* through 38*d*, as well as fastening strips 38*e* and 38*f* (attached to bladder 30 on either side of valve 36 as shown), fasten bladder 30 to corresponding fastening strips, preferably formed of disengagable loop material, on the interior surface of the helmet's outer shell (not shown in FIG. 5).

As further shown in FIG. 5, first interconnected segment group 52 includes segments 52*a*, 52*b*, 52*c* and 52*d*, all formed of resilient material. Fastening strips 58*a*, 58*b*, 58*c* and 58*d*, preferably formed of disengagable hook material, are attached to the exterior facing sides of segments 52*a*, 52*b*, 52*c* and 52*d*, respectively. Strips 58*a* through 58*d* interact with corresponding fastening strips, preferably formed of disengagable loop material, on the interior facing side of bladder 30 (not shown in FIG. 5) to fasten segment group 52 to bladder 30. Second interconnected segment group 54 includes crown portion 54*a* and individual segments 54*b*, 54*c*, 54*d* and 54*e*, all formed of resilient material. Fastening strips 56*b*, 56*d* and 54*e*, preferably formed of disengagable hook material, are attached to the exterior facing sides of segments 54*b*, 54*d* and 52*e*, respectively. Strips 56*b*, 56*d* and 56*e* interact with corresponding fastening strips, preferably formed of disengagable loop material, on the interior surface of the helmet's outer shell (not shown in FIG. 5) to fasten segment group 54 to the outer shell.

In the preferred embodiment, segments 52*a* through 52*d* have a "sandwiched" or laminated structure. In particular, the segments are each composed of a first portion of resilient material that includes an internal pocket or void at its core. The resilient material forming this first portion or outer jacket is preferably cross-linked polyethylene. A second portion of energy absorbing material having a resiliency less than that of the first portion is disposed within the pocket of the first portion to form the sandwiched structure. Preferable materials for this second portion include vinyl nitryl blend (commercially available under the trademark DeCello), expanded vinyl, expanded polystyrene, polyurethane, cross-linked polyethylene, and natural rubber. It has been found that the energy absorbing capability of the liner is enhanced when at least some of the segments forming the liner have such a sandwiched structure.

Figure 6:
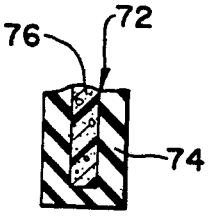
FIG. 6 is a sectional view taken in the direction of line 6—6 of FIG. 4.

Turning to FIG. 6, a sectional view of the internal structure of liner segment 52*a* is illustrated. As shown in FIG. 6, liner segment 52*a* comprises a first portion 74 of resilient material having an internal pocket 72 formed therein. A second portion 76 of resilient material is disposed within pocket 72. The resiliency of the first portion is preferably different from the resiliency of the second portion. Most preferably, the resiliency of the first portion is greater than the resiliency of the second portion.

Figure 7:
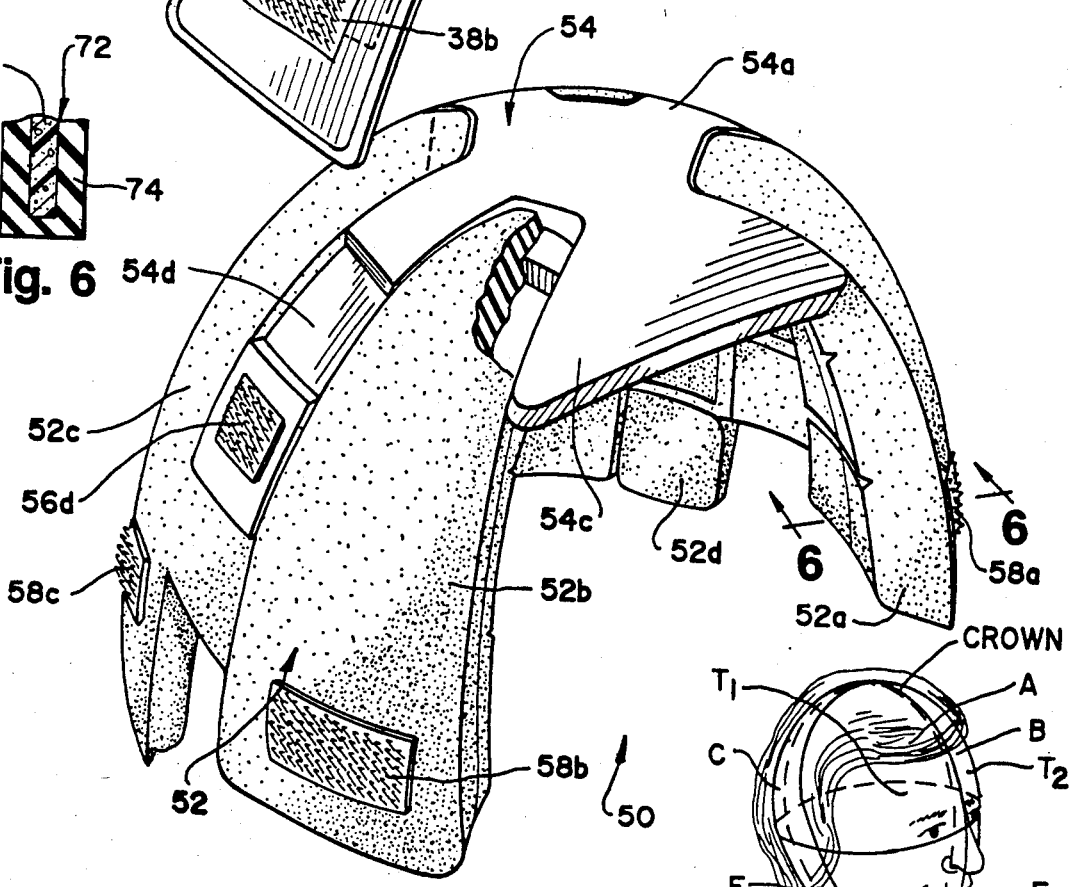
FIG. 7 is a perspective view of a wearer's head, illustrating various octants of the head.
Figure 7:
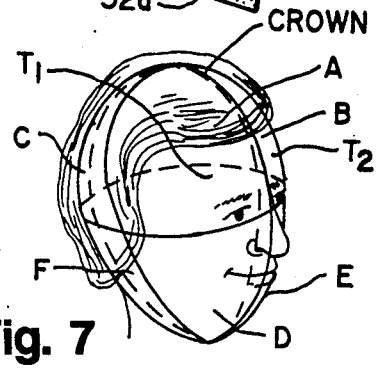

Turning finally to FIG. 7, a perspective view of a typical wearer's head, illustrating various octants of the head, is shown. Octant A is the upper right front octant of the wearer's head, and includes the right temple $T_1$. Octant B is the upper left front octant of the wearer's head, and includes the left temple $T_2$. Octant C is the upper right rear octant of the wearer's head. Octant D is the lower right front octant of the wearer's head. Octant E is the lower left front octant of the wearer's head, and is located diagonally opposite octant C. Octant F is the lower right rear octant of the wearer's head, and includes the portion immediately above the base of the skull. Octant F is located diagonally opposite octant B. The upper left rear octant (diagonally opposite octant D) and the lower left rear octant (diagonally opposite octant A) are not illustrated in FIG. 7. The crown or topmost region of the wearer's head is also illustrated in FIG. 7. The terms "head" and "skull" have been used interchangeably herein.

While particular embodiments and applications of the present invention have been shown and described, it will be understood, of course, that the invention is not limited thereto since modifications may be made by those skilled in the art, particularly in light of the foregoing teachings. It is therefore contemplated by the appended claims to cover any such modifications as incorporate those features which come within the true spirit and scope of the invention.

What is claimed is:

1. A protective helmet comprising an outer shell and an inflatable bladder mounted on the interior surface of said shell, said bladder consisting of four diagonally opposed inflatable cells extending downwardly from the crown of said outer shell, two of said cells extending to the lower rear octants of the wearer's head and the other two of said cells extending to the upper front octants of the wearer's head, said cells inflatable through a single valve, whereby inflation of said cells adjusts the position of the helmet to secure the helmet at the lower rear octants and to elevate the helmet from the head at the upper front octants.

2. The protective helmet of claim 1, said bladder mounted by fastening means to the inner surface of said outer shell.

3. The protective helmet of claim 2, said fastening means comprising disengagable hook and loop fastening material.

4. A protective helmet comprising:

an outer shell;

an inflatable bladder mounted on the interior surface of said shell, said bladder consisting of four diagonally opposed inflatable cells extending to the lower rear octants of the wearer's head and to the upper octants of the wearer's head, said cells inflatable through a single valve; and a liner formed of resilient material, said liner interposed between said inflatable bladder and the wearer's head;

whereby inflation of said cells adjusts the position of the helmet to secure the helmet at the lower rear octants and to elevate the helmet from the head at the upper octants.

5. The protective helmet of claim 4 wherein said liner comprises spaced segments of resilient material extending downwardly from the crown of said outer shell, whereby heat radiated from the wearer's head is ventilated to said outer shell.

6. The protective helmet of claim 5 wherein said liner comprises an assembly of first interconnected segments of resilient material and second interconnected segments of resilient material engagable with said first segments, said liner substantially covering the interior surface of said outer shell.

7. A protective helmet comprising:

an outer shell;

an inflatable bladder mounted on the interior surface of said shell, said bladder consisting of four diagonally opposed inflatable cells extending to the lower rear octants of the wearer's head and to the upper octants of the wearer's head, said cells inflatable through a single valve;

a liner formed of resilient material, said liner interposed between said inflatable bladder and the wearer's head;

said liner comprising alternating radially spaced segments of resilient material whereby heat radiated from the wearer's head is ventilated to said outer shell, at least one of said segments comprising a first portion of resilient material having an internal pocket formed therein, and a second portion of resilient material disposed within said pocket, said first portion having a resiliency greater than the resiliency of said second portion;

whereby inflation of said cells adjusts the position of the helmet to secure the helmet at the lower rear octants and to elevate the helmet from the head at the upper octants.

8. The protective helmet of claim 7 wherein said first portion is formed of cross-linked polyethylene.

9. A protective helmet comprising:

an outer shell;

an inflatable bladder mounted on the interior of said shell, said bladder having a plurality of cells extending to the lower rear octants of the wearer's skull and to the upper octants of the wearer's skull, said cells inflatable through a single valve;

a liner interposed between said inflatable bladder and the wearer's head, said liner comprising an assembly of first interconnected segments of energy absorbing material, said first segments extending downwardly from the crown of said outer shell, and second interconnected segments of energy absorbing material, said second segments extending downwardly from the crown of said outer shell, said second segments engagable with and spaced from said first segments, said liner substantially covering the interior surface of said outer shell, at least one of said segments comprising a first portion of energy absorbing material having an internal pocket formed therein and a second portion of energy absorbing material disposed within said pocket, the energy absorbing material of said first portion having a resiliency different from the resiliency of the energy absorbing material of said second portion.

10. The protective helmet of claim 9 wherein said first portion is formed of cross-linked polyethylene.

* * * * *